US005174117A

United States Patent [19]

Naito et al.

[11] Patent Number: 5,174,117

[45] Date of Patent: Dec. 29, 1992

[54] FREE PISTON STIRLING ENGINE

[75] Inventors: Yoshihiro Naito, Nagoya; Takanori Hamajima, Aichi; Yoshihiro Naruse, Ichikawa, all of Japan

[73] Assignee: Aisin Seiki Kabushiki Kaisha, Kariya, Japan

[21] Appl. No.: 766,523

[22] Filed: Sep. 27, 1991

[30] Foreign Application Priority Data

Sep. 28, 1990 [JP] Japan ..... 2-256860

[51] Int. Cl.[5] ..... F02G 1/06

[52] U.S. Cl. ..... 60/520

[58] Field of Search ..... 60/520

[56] References Cited

U.S. PATENT DOCUMENTS

| | | | |
|---|---|---|---|
| 4,458,489 | 7/1984 | Walsh | 60/520 |
| 4,567,726 | 2/1986 | Vitale et al. | 60/520 |
| 4,642,547 | 2/1987 | Redlich | 60/520 X |

*Primary Examiner*—Allen M. Ostrager
*Attorney, Agent, or Firm*—Burns, Doane, Swecker & Mathis

[57] ABSTRACT

A free piston Stirling engine includes a displacer fitted in a cylinder so as to be able to reciprocate and defining an expansion chamber and a compression chamber in the cylinder, an operational sealing area leading from the expansion chamber to the compression chamber and interposed a heater, a regenerator and a cooler in order, a free piston disposed so as to be able to reciprocate toward a direction which crosses a direction of the reciprocation of the displacer and defining an operational chamber which is communicated with the compression chamber and a buffer chamber at its both ends and a linear generator disposed around the free piston and connected with a storage battery at its output terminal via an AC/DC converter having one or more transformation ratios. According to this constitution, even though the load is larger than the output of the linear generator transitionary, it is possible to supply stable electric power by use of the storage battery. In the opposite direction, it is possible to store the surplus energy in the storage battery when the load is smaller than the output of the linear generator. Accordingly, even though the output of the free piston Stirling engine is under the unbalance condition with regard to the load quantity, especially when the load quantity is larger than the output of the free piston Stirling engine, the free piston Stirling engine can be stably operated.

4 Claims, 3 Drawing Sheets

FREE PISTON STIRLING ENGINE

BACKGROUND OF THE INVENTION

1. Field of the Invention

The present invention relates to a free piston Stirling engine, and more particularly to a free piston Stirling engine for driving a linear generator which has a regulation function of output.

2. Description of the Prior Art

A conventional free piston Stirling engine 13, in general, is provided with following structures as shown in FIG. 1 and operates as follows.

A displacer 4 is air-tightly fitted in a cylinder so as to be able to reciprocate and defines an expansion chamber 11 and a compression chamber 12 in the cylinder. The expansion chamber 11 is communicated with the compression chamber 12 via a heater 1, a regenerator 2 and a cooler 3. In an operational sealing area leading from the expansion chamber 11 to the compression chamber 12, the operational gas such as helium is enclosed. The heater 1 is constituted so that it can be heated by solar heat and so on via many layers of heat sealed 5. The displacer 4 is connected with a rod 10 and reciprocates with the rod 10.

A pair of power pistons, namely free pistons 6 are disposed so that the moving direction of free pistons 6 crosses the reciprocation direction of the rod 10. At an one end of each free piston 6, an operational chamber 18 which is communicated with the compression chamber 12 is defined. On the other hand, a buffer chamber 9 is defined by a cover 19 at the other end of each free piston 6. The covers 19 are provided with projection portions at their center portions and each projection portion is slidably inserted in center opening portion of each free piston 6. Thereby, a gas spring 8 is formed in the center opening portion of each free piston 6. Accordingly, each free piston 6 is constituted so as to be able to freely reciprocate between the operational chamber 18 and the buffer chamber 9. Namely, the free pistons 6 are reciprocated by the compressed operational gas which is periodically supplied from the compression chamber 12 to the operational chambers 18. A pair of linear generators 7 are disposed around the free pistons 6 so as to generate electricity by the reciprocation of the free pistons 6.

When the free piston Stirling engine is activated, the rotational torque of a motor (not shown) is transmitted to the rod 10 via a yoke-cam mechanism and then the displacer 4 is forcibly reciprocated. On the other hand, the operational gas is heated by the solar heat and so on supplied to the heater 1 via many layers of heat sealed 5 and then the operational gas with high temperature and high pressure which is heated by the heater 1 is isothermally expanded in the expansion chamber 11. Next, the operational gas from the regenerator 2 is cooled by the cooler 3 and is isothermally compressed in the compression chamber 12. Thereby, the displacer 4 is reciprocated without the rotational torque of a motor. On the other hand, the operational gas which is compressed goes in and out the operational chambers 18 and the free pistons 6 are forcibly reciprocated. Thereby, the linear generators 7 are activated.

The linear generators 7 are comprised of permanent magnets which are fixed to the outer circumferential surface of the other ends of the free pistons 6 and coils which are fixed to housing located around the permanent magnets. Thereby, the electromotive force is generated in the coils by the reciprocation of the free pistons 6 and the requisite output voltage is obtained by means of selectively changing the taps of the coils by a load sensor (not shown).

In fact, as disclosed in U.S. Pat. No. 4,642,547, the output voltage of the linear generator 7 is regulated as follows. The output voltage of the linear generator is detected by a voltage detector and is compared with a standard value of a voltage setting device. Then the current which flows in a false load connected with the output terminal of the linear generator is regulated in response to the result of the comparison and the output voltage which is supplied to the load is pertinently maintained.

A summary of the above described prior voltage regulation is shown below. When the output voltage of the linear generator is larger than the requisite output voltage of the load, the current is flown in the false load and the voltage which is supplied to the load is lowered. Thereby, the load is prevented from experiencing excessive voltage.

In this voltage regulation, however, the difference between the output of the engine and the quantity of the load is uselessly thrown away as the false load. If the number of the taps of coils is increased and then the changes of the taps of the coils are increased, it is possible to reduce the energy which is wasted in the false load. According to this means, however, the operation for changing the taps of the coils increases and therefore the annexed device is necessitated. Accordingly, it is able to prevent the enlargement of the total size of the free piston Stirling engine and furthermore the operational unforeseen accident such as tap failure is caused.

SUMMARY OF THE INVENTION

It is, therefore, an object of the present invention to provide an improved free piston Stirling engine which overcomes a drawback of the prior art.

It is another object of the present invention to provide an improved free piston Stirling engine which can reduce a waste of energy without increasing the total size of the free piston Stirling engine and causing the above operational unforeseen accident.

In order to achieve these objects, there is provided an improved free piston Stirling engine that includes a displacer fitted in a cylinder so as to be able to reciprocate and defining an expansion chamber and a compression chamber in the cylinder, an operational sealing area leading from the expansion chamber to the compression chamber and interposed a heater, a regenerator and a cooler in order, a free piston disposed so as to be able to reciprocate toward a direction which crosses a direction of the reciprocation of the displacer and defining an operational chamber which is communicated with the compression chamber and a buffer chamber at its both ends and a linear generator disposed around the free piston and connected with a storage battery at its output terminal via a AC/DC converter having one or more transformation ratios.

BRIEF DESCRIPTION OF THE DRAWINGS

Additional objects and advantages of the present invention will become more apparent from the following detailed description of a preferred embodiment thereof when considered with reference to the attached drawings, in which.

DESCRIPTION OF THE PREFERRED EMBODIMENTS

Figure 1:
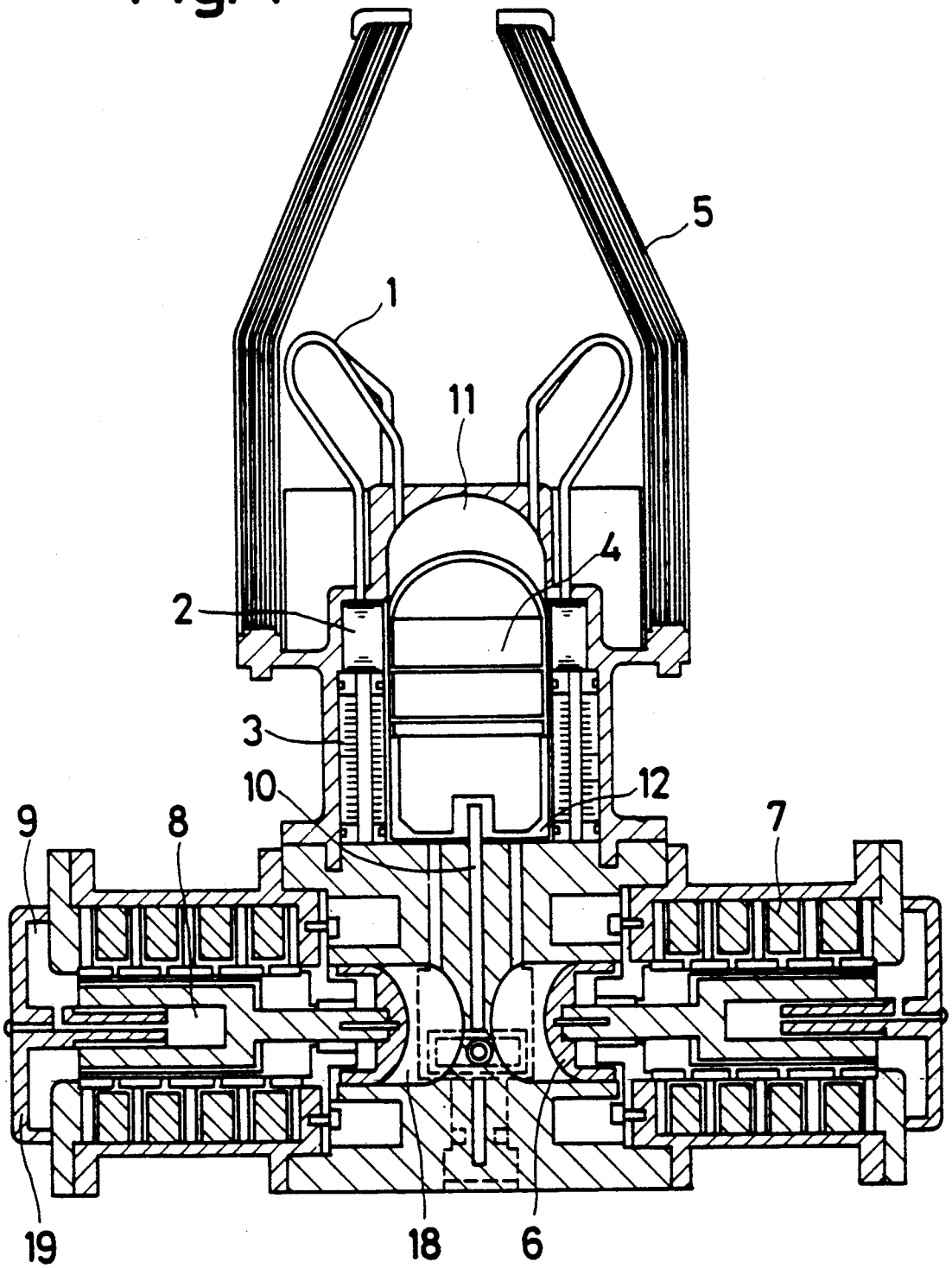
FIG. 1 is a sectional view of a free piston Stirling engine.

A free piston Stirling engine constituted in accordance with a preferred embodiment of the present invention will be described with reference to the drawings. Now, since a basic structure of the free piston Stirling engine has been already explained according to FIG. 1, the explanation of structures of the free piston Stirling engine is omitted.

Figure 2:
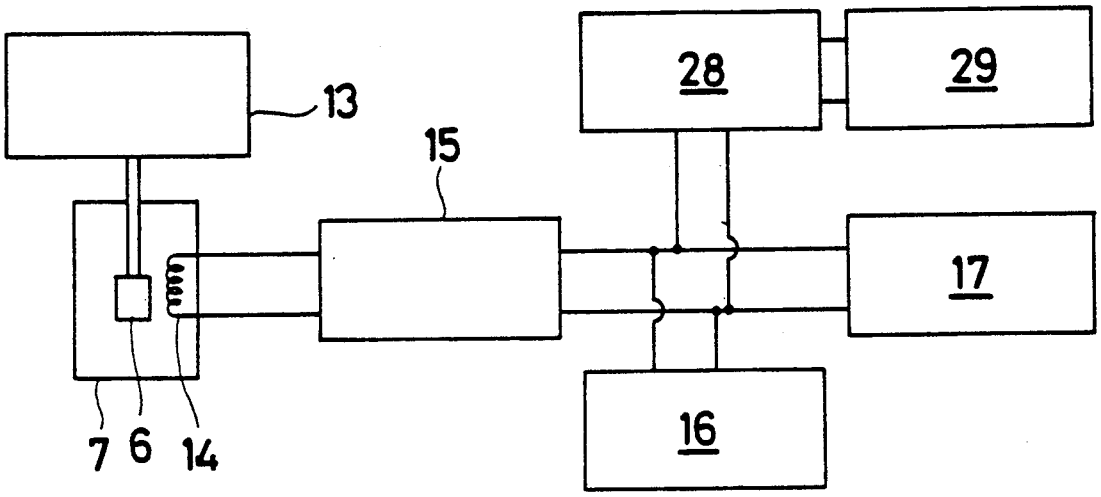
FIG. 2 is a block diagram of an embodiment of a free piston Stirling engine in accordance with the present invention.

Referring to FIG. 2, the free piston Stirling engine 13 reciprocates a free piston 6 which is disposed in a linear generator 7 and makes a coil 14 generate an electromotive force. Thereby, the free piston Stirling engine 13 generates an electric power as its own output. Such an electric power is in proportion to the moving velocity of the free piston 6, namely the stroke and the frequency of the free piston and the stroke and the output voltage are dominated by a load current.

Figure 3:
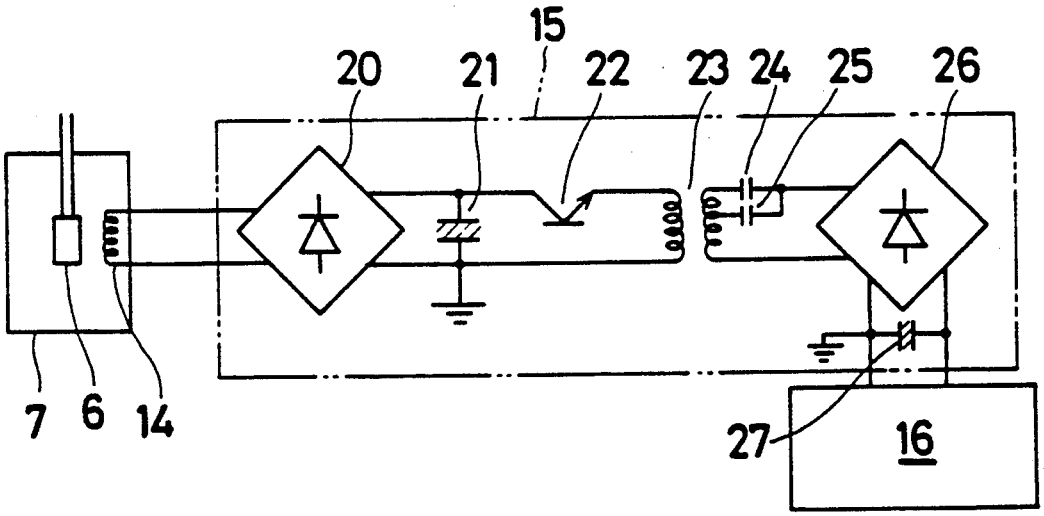
FIG. 3 is a circuit diagram of an AC/DC converter of an embodiment of a free piston Stirling engine in accordance with the present invention.

This electric power is supplied to an AC/DC converter 15 which is briefly shown in FIG. 3. Referring to FIG. 3, the electromotive force generated in the coil 14 of the linear generator 7 is rectified by a full-wave rectifier 20 and then is converted into a direct current by a smoothing condenser 21. Next, the electromotive force is converted into a high-frequency alternating current by a switching element 22 and then is transmitted to a storage battery 16 via a rectifier 26 and a smoothing condenser 27 after transformation by a transformer 23. The transformer 23 is provided with one piece or more than two pieces of taps 24, 25 and has a function which selectively regulates the transformation ratio so as to optimize the efficiency of the linear generator 7 in response to the output of the linear generator 7. Now, referring to FIG. 2, numeral 17 is a direct current load which is connected with the storage battery 16 in parallel and numeral 29 is a alternating current load which is connected with the storage battery 16 via a DC/AC converter 28 in parallel.

As a result, the secondary voltage of the transformer 23 is dominated by the terminal voltage of the storage battery 16 (the capacity of the storage battery is fairly larger than the rated output of the linear generator 7) and the primary voltage of the transformer 23 is dominated by the terminal voltage of the storage battery 16 and the turn ratio which is chosen by the taps 24, 25. Thereby, the stroke of the free piston 6 of the linear generator 7, in other words, the output voltage of the linear generator 7 is maintained with regard to the output of the free piston Stirling engine 13 in the most suitable manner.

Figure 4:
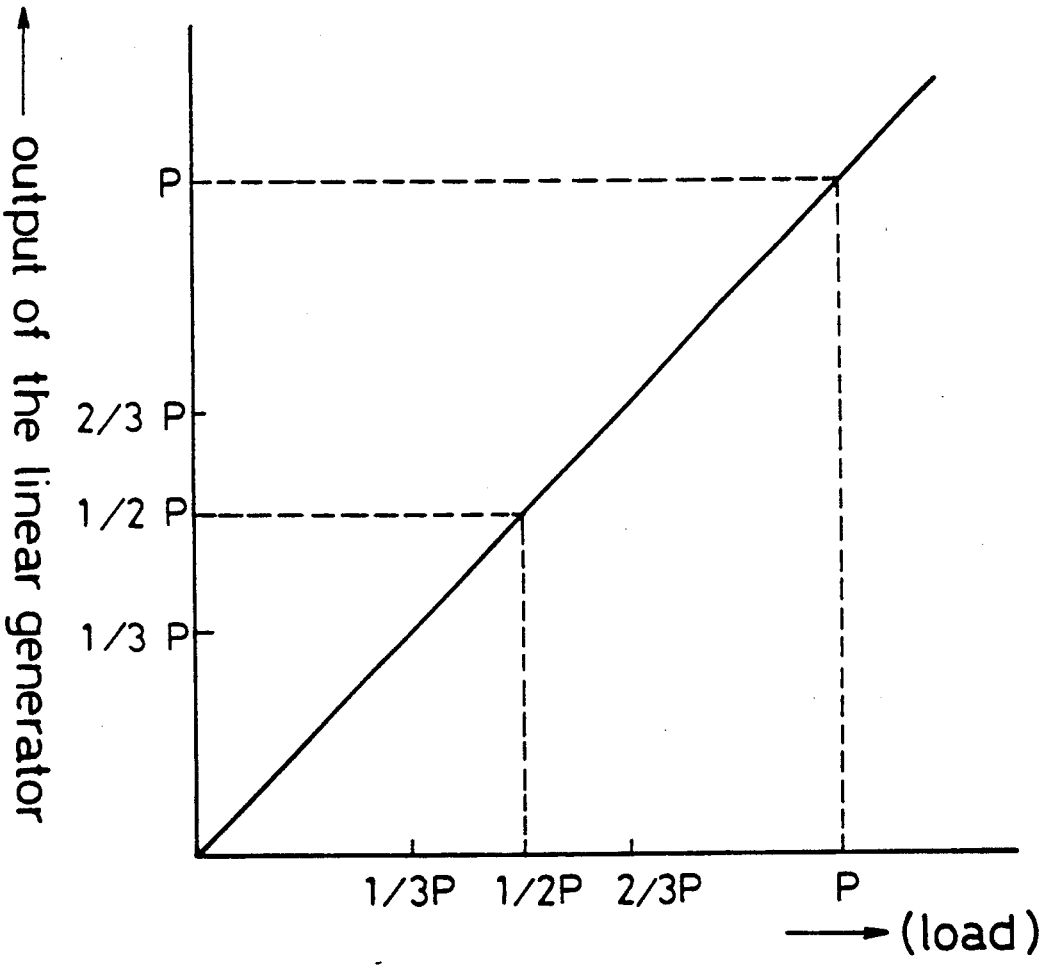
FIG. 4 is a graph which show a relationship between a load and an output of a linear generator of an embodiment of a free piston Stirling engine in accordance with the present invention.

Accordingly, as shown in FIG. 4, the rated output P of the linear generator 7 (the free piston Stirling engine 13) is the same value as the energy which can supply with the load continuously. Even though the output of the linear generator 7 is ½ P, it is able to take out as many as ½ P.

Furthermore, according to this embodiment, since the storage battery 16 is connected with the output terminal of the linear generator 7 via the AC/DC generator 15, even though the load is larger than the output of the linear generator 7 transistionary, it is possible to supply stable electric power by the storage battery 16. In the opposite direction, when the load is smaller than the output of the linear generator 7, it is possible to store the surplus energy in the storage battery 16. Therefore, it is possible to reduce energy waste without increasing the total size of the free piston Stirling engine and causing the above operational unforeseen accident.

As mentioned above, according to the present invention, even though the output of the free piston Stirling engine is under the unbalance condition with regard to the load quantity, especially even though the load quality is larger than the output of the free piston Stirling engine, the free piston Stirling engine can be stably operated. This advantage is effective when the free piston Stirling engine is operated under the condition which can not control the amount of the heat input such as solar heat (when the solar heat is supplied to the heater of the free piston Stirling engine as heat source).

The principles, and preferred embodiment of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in appended claims.

What is claimed:

1. A free piston Stirling engine comprising:

a displacer fitted in a cylinder so as to be able to reciprocate, said displacer defining an expansion chamber and a compression chamber in the cylinder;

an operational sealing area leading from the expansion chamber to the compression chamber and having interposed in order a heater, a regenerator and a cooler;

a free piston disposed so as to be able to reciprocate in a direction which crosses a direction of reciprocation of the displacer, said free piston defining an operational chamber at one of its ends which communicates with the compression chamber and a buffer chamber at its end opposite the operational chamber; and a linear generator disposed around the free piston and connected with a storage battery at its output terminal via an AC/DC converter one or more transformation ratios.

2. A free piston Stirling engine as recited in claim 1, wherein surplus energy is stored in the storage battery when the load is smaller than the output of the linear generator.

3. A free piston Stirling engine as recited in claim 2, wherein a stable electric power is supplied to the load by use of the storage battery when the load is bigger than the output of the linear generator transitionary.

4. A free piston Stirling engine as recited in claim 3, wherein the heater is heated by solar energy.

* * * * *